US010081993B2

(12) United States Patent
Walker et al.

(10) Patent No.: US 10,081,993 B2
(45) Date of Patent: Sep. 25, 2018

(54) MOBILE DRILLING FLUID PLANT

(71) Applicant: Halliburton Energy Services, Inc., Houston, TX (US)

(72) Inventors: Piper Shawn Walker, Houston, TX (US); Lawrence LePere, Houston, TX (US); Terry Wayne Brown, Sugar Land, TX (US); James Andrew Finkle, London (CA); Ron Crawford, Tomball, TX (US); Ryllee Tettleton, Tomball, TX (US); Larry Wolfson, Knox, IN (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 600 days.

(21) Appl. No.: 14/427,028

(22) PCT Filed: Jul. 11, 2014

(86) PCT No.: PCT/US2014/046388
§ 371 (c)(1),
(2) Date: Mar. 10, 2015

(87) PCT Pub. No.: WO2015/160374
PCT Pub. Date: Oct. 22, 2015

(65) Prior Publication Data

US 2017/0138134 A1 May 18, 2017

Related U.S. Application Data

(60) Provisional application No. 61/979,374, filed on Apr. 14, 2014.

(51) Int. Cl.
*E21B 21/00* (2006.01)
*E21B 21/06* (2006.01)
(Continued)

(52) U.S. Cl.
CPC ..... *E21B 21/062* (2013.01); *B01F 5/0206* (2013.01); *E21B 21/01* (2013.01); *B01F 2215/0081* (2013.01); *E21B 2021/007* (2013.01)

(58) Field of Classification Search
CPC .. E21B 21/62; E21B 2021/007; E21B 21/062; E21B 21/01; B01F 5/0206; B01F 2215/0081
See application file for complete search history.

(56) References Cited

U.S. PATENT DOCUMENTS 5,896,883 A * 4/1999 Khalatbari ..... B01F 13/0035 137/255
2009/0312885 A1* 12/2009 Buiel ..... H02J 3/32 700/297

(Continued)

FOREIGN PATENT DOCUMENTS

EP 1484472 A1 12/2004
WO 2015160374 A1 10/2015

OTHER PUBLICATIONS

International Search Report and Written Opinion for PCT/US2014/046388 dated Jan. 14, 2015.

*Primary Examiner* — Anshu Bhatia
(74) *Attorney, Agent, or Firm* — McDermott Will & Emery LLP

(57) ABSTRACT

An example mobile drilling fluid plant includes a plurality of intermodal containers each exhibiting a length, a width, and a height compliant with universal shipping container dimensions and configurations dictated by the International Organization for Standardization, wherein the plurality of intermodal containers include a plurality of fluid storage containers and one or more fluid mixing containers, one or more pumps in fluid communication with the plurality of fluid storage containers and the one or more fluid mixing
(Continued)

containers, and one or more flexible hoses fluidly coupled to the one or more pumps and placing the plurality of fluid storage containers in fluid communication with the one or more fluid mixing containers.

15 Claims, 4 Drawing Sheets

(51) Int. Cl.
*E21B 21/01* (2006.01)
*B01F 5/02* (2006.01)

(56) References Cited

U.S. PATENT DOCUMENTS

| | | | |
|---|---|---|---|
| 2010/0319921 | A1 | 12/2010 | Eia et al. |
| 2012/0255734 | A1 | 10/2012 | Coli et al. |
| 2014/0020892 | A1 | 1/2014 | Oren et al. |

* cited by examiner

MOBILE DRILLING FLUID PLANT

CROSS-REFERENCE TO RELATED APPLICATIONS

This application is a National Stage entry of and claims priority to International Application No. PCT/US2014/046388, filed on Jul. 11, 2014, which claims priority to U.S. Provisional Patent App. No. 61/979,374, which was filed on Apr. 14, 2014.

BACKGROUND

The present disclosure is related to oilfield equipment and, more particularly, to a portable plant for mixing, storing, and delivering drilling fluid.

In the oil and gas industry, well operators face numerous challenges related to drilling fluid accessibility while drilling wellbores used to extract hydrocarbons from subterranean formations. Solutions for logistical factors relating to drilling fluid accessibility, such as operating a drilling rig in a remote location or a drilling rig with limited power and/or fuel resources, often go unfounded. Other limitations, such as storage capabilities, location, and power sourcing can also present specifically challenging tasks during wellbore drilling operations. Drilling fluid storage capacity, for example, plays a large role in daily operations and is directly limited by a well operator's allowable onsite footprint, or lack thereof. Moreover, increasing environmental regulations and added storage and/or disposal costs result in well operators seeking effective solutions that can meet health and safety regulations and thereby reduce the number of incidents.

Drilling fluid plants or facilities typically include permanent installation built at planned and permitted wellbore drilling sites. Although, some existing drilling fluid installations are purportedly "portable", even those require major capital investment for preparation of the site (e.g., installation of concrete footings and/or slabs) and a long lead-time for deployment/construction and commissioning. Under the laws of some countries and territories a "portable" drilling fluid installation is treated as "permanent" if concrete footings and/or slabs are installed.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to oilfield equipment and, more particularly, to a portable plant for mixing, storing, and delivering drilling fluid.

The embodiments of the present disclosure provide a mobile solution for mixing, storing, and delivering drilling fluid or "mud" to oil and gas drilling facilities. The presently described embodiments may prove advantageous in providing drilling fluid to locations where the total life of the drilling operation is unknown, where there is not time to build a permanent plant prior to meeting customer timelines, and/or where it is desirable to test the viability of market penetration prior to making a permanent capital expenditure. The embodiments of the mobile drilling fluid plant disclosed herein may employ a plurality of intermodal containers for storing and mixing drilling fluid. Each intermodal container may exhibit standardized shipping configurations and dimensions, thereby allowing the mobile drilling fluid plant to take advantage of the global containerized intermodal freight transport system.

The mobile drilling fluid plants of the present disclosure are designed for mobility and scalability suitable for the most remote locations in the world, and deployment is not contingent upon the availability of power since the mobile drilling fluid plants may include power generators that supply remote power. The exemplary mobile drilling fluid plants of the present disclosure are ideal for well operators needing drilling fluid storage and mixing options on either a temporary or a long-term basis. Moreover, such mobile drilling fluid plants may be rapidly deployed, such as within 1-2 weeks upon arrival, and exhibit a verifiable commissioning phase with minimal downtime during the configuration process. Accordingly, the presently described mobile drilling fluid plants may provide a well operator or driller with increased portability for drilling fluid, low cost for construction requirements, and fast deployment and demobilization.

Figure 1A:
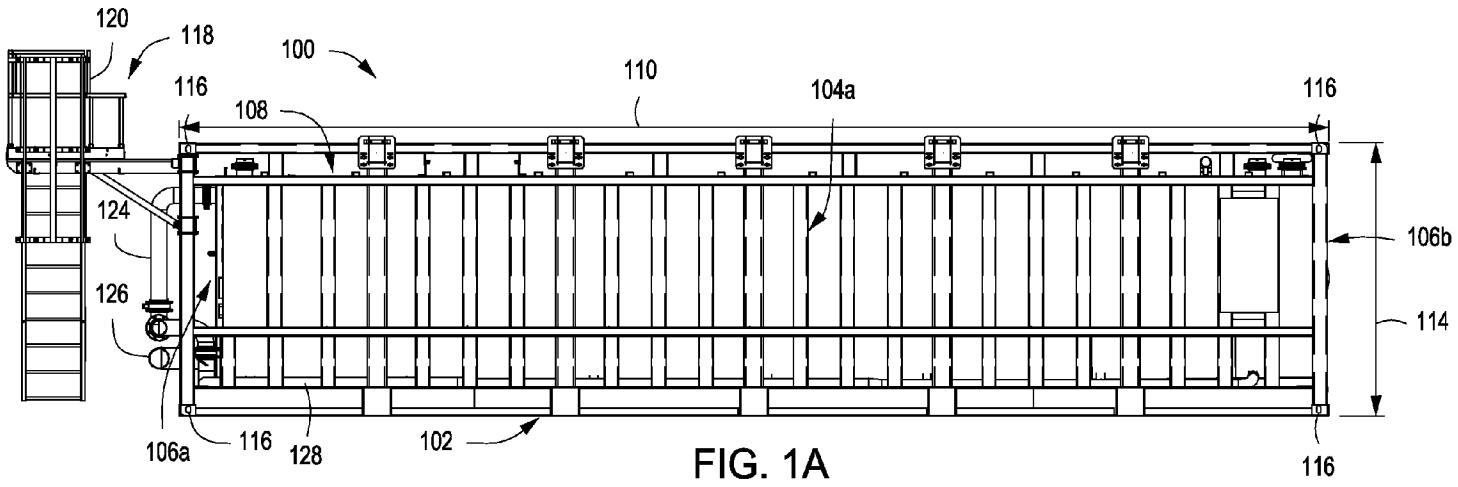
FIGS. 1A-1C depict various views of an exemplary intermodal container that may be used in accordance with embodiments of the present disclosure.
Figure 1C:
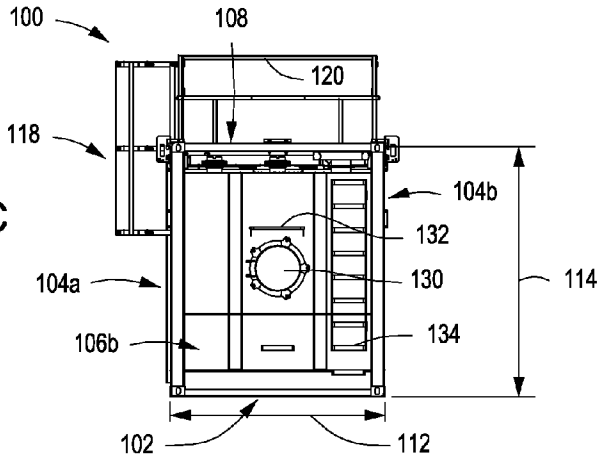
Figure 1B:
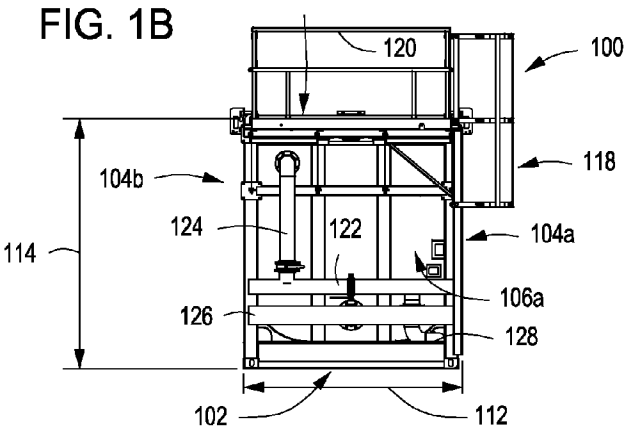

Referring now to FIGS. 1A-1C, illustrated are various views of an exemplary intermodal container 100 that may be used in accordance with the present disclosure, according to one or more embodiments. More particularly, FIG. 1A depicts a side view of the intermodal container 100, FIG. 1B depicts a front-end view of the intermodal container 100, and FIG. 1C depicts a back end view of the intermodal container 100. As illustrated, the intermodal container 100 may be a substantially rectangular structure that includes a base 102, opposing first and second sidewalls 104*a* and 104*b*, opposing first and second ends 106*a* and 106*b*, and a roof 108.

In some embodiments, the intermodal container 100 may be an intermodal shipping container, such as a standardized ISO container that is compliant with universal shipping dimensions and configurations as dictated by the International Organization for Standardization (ISO). More particularly, the intermodal container 100 may exhibit a length 110, a width 112, and a height 114 that complies with ISO universal standards and configurations such that the intermodal container 100 is able to take advantage of the global containerized intermodal freight transport system. As a result, the intermodal container 100 may be moved from one mode of transport to another, such as from ship, to rail, to truck, etc., without requiring unloading and reloading of the contents disposed within the intermodal container 100.

In accordance with ISO standards, the width 112 of the intermodal container 100 may be 8 feet (2.438 meters). In some embodiments, the intermodal container 100 may exhibit a length 110 of about 20 feet (i.e., 19 feet and 10.5 inches; 6.058 meters). In other embodiments, however, the length 110 of the intermodal container 100 may be 40 feet (12.192 meters). Moreover, in some embodiments, the height 114 of the intermodal container 100 may be 8 feet (2.438 meters). In other embodiments, however, the intermodal container 100 may be characterized as a "high-cube" container, which exhibits a height 114 of 9 feet and 6 inches (2.896 meters), without departing from the scope of the disclosure.

In accordance with ISO container specifications, the intermodal container 100 may further include castings 116 at each corner (eight in total) that are used to stack and secure multiple intermodal containers 100 atop one another. Each casting 116 may include appropriate openings configured to receive twistlock fasteners (not shown), or the like, that allow a second intermodal container (not shown) to be placed atop the depicted intermodal container 100 and be suitably coupled thereto. Accordingly, two or more intermodal containers 100 may be stacked atop one another and secured together at the castings 116, thereby providing a well operator with a smaller required footprint.

According to the present disclosure, as will be described in greater detail below with reference to FIG. 4, the intermodal container 100 may form part of a mobile drilling fluid plant 400 that includes multiple types of intermodal containers 100 that are used for varying purposes in mixing, storing, and delivering drilling fluid to a drilling rig or installation. Accordingly, variations of the intermodal container 100 may provide a well operator with several types of containers that may be used to erect and establish the mobile drilling fluid plant 400 for temporary or long-term use in supporting drilling operations. Such variations or types of the intermodal container 100 may include, but are not limited to, a fluid storage container, a fluid mixing container, an office, a restroom, a fluid test facility, a generator housing, a motor control center, a fluid pump with dry bulk or mix hopper container, a pump skid, a mixing skid, and any combination thereof. Each of these types of containers may be compliant with universal ISO standards and sizing such that each may be transported to the drill site via the global containerized intermodal freight transport system.

In the illustrated embodiment of FIGS. 1A-1C, the intermodal container 100 is depicted as a drilling fluid storage container configured to contain and store drilling fluid or "mud" for use in downhole drilling operations. Moreover, the intermodal container 100 is depicted in a deployed configuration and otherwise ready for use. As illustrated, the intermodal container 100 may include a vertical telescoping ladder 118 that may be secured at the first end 106*a*. For safety, in some embodiments, the ladder 118 may include a removable handrail 120. The ladder 118 may be used to access the roof 108 of the intermodal container 100, but may also prove advantageous in accessing a second intermodal container (not shown) that may be stacked atop the intermodal container 100 and secured thereto at the castings 116.

As best seen in FIG. 1B, various piping and/or conduits may be arranged at the first end 106*a* of the intermodal container 100. More particularly, the intermodal container 100 may include at least a sump conduit 122, an inlet conduit 124, a cross-connection conduit 126, and a mud gun line 128. The sump conduit 122 is fluidly coupled to a fluid tank 302 (FIGS. 3A and 3B) disposed within the intermodal container 100 and provides a conduit to draw fluids (e.g., drilling fluid) out of the intermodal container 100 to feed one or both of the inlet conduit 124 and the mud gun line 128. The inlet conduit 124 circulates the fluid back into the interior of the intermodal container 100 at a location at or near the roof 108. On the other hand, the mud gun line 128 extends along the base 102 of the intermodal container 100 from the first end 106*a* toward the second end 106*b*. As discussed below, the mud gun line 128 feeds fluid (e.g., drilling fluid) to a plurality of mud guns (not shown) extending into the fluid tank 302 (FIGS. 3A and 3B) inside the intermodal container 100. The cross-connection conduit 126 may facilitate fluid transfer between adjacent fluid storage containers, such as two or more adjacent intermodal containers 100.

Each of the sump conduit 122, the inlet conduit 124, the cross-connection conduit 126, and the mud gun line 128 may comprise rigid or non-rigid piping and/or conduits deployable and commissioned onsite. Moreover, while not shown, suitable valving and interconnections may be included in the piping and/or conduits arranged at the first end 106*a* to facilitate automated operation. Furthermore, while a particular configuration of the piping and/or conduits is depicted in FIGS. 1A and 1B, it will be appreciated that several variations of the configuration are equally contemplated herein, without departing from the scope of the disclosure.

At the second end 106*b* of the intermodal container 100, as best seen in FIG. 1C, the intermodal container 100 may further include a manway 130, a grab handle 132, and a flat bar ladder 134. The manway 130 may provide access into the interior of the intermodal container 100. In some embodiments, for instance, the manway 130 may be removable from the second end 106*b*. In other embodiments, the manway 130 may be latched and hinged to the second end 106*b* such that the manway 130 may be unlatched and opened by pivoting about the hinge. The flat bar ladder 134 may provide a well operator access onto the roof 108 of the intermodal container 100. While not labeled, the intermodal container 100 may further include a thief hatch and a radar measurement device. The thief hatch may allow access into the interior of the intermodal container 100 via one of the sidewalls 104*a,b* for making a physical, local measurement of fluids disposed therein. The radar measurement device (and associated flange) may be used to monitor the fluid level in the interior of the intermodal container 100 and transmit such readings to an adjacent office or laboratory.

Figure 2:
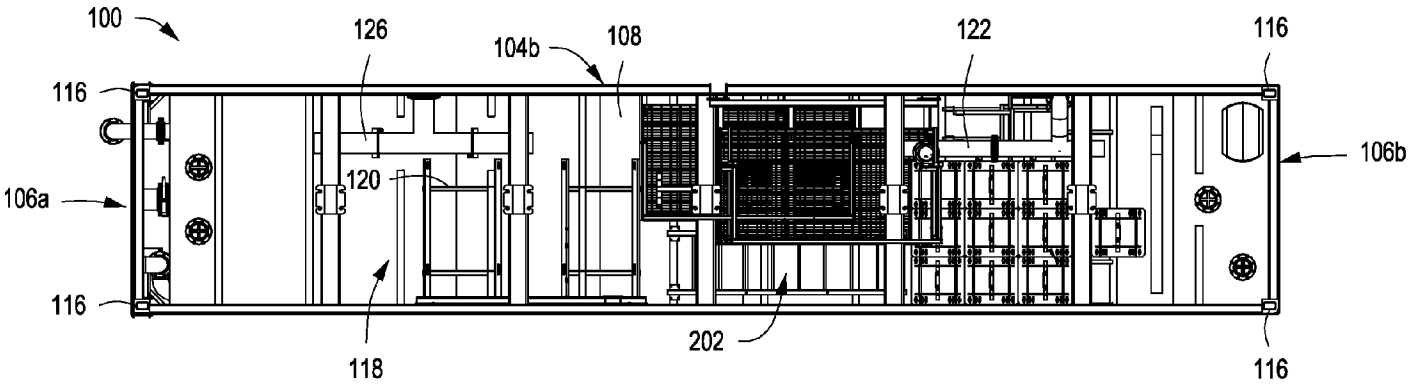
FIG. 2 illustrates a top view of the intermodal container of FIGS. 1A-1C, according to one or more embodiments.

Referring now to FIG. 2, with continued reference to FIGS. 1A-1C, illustrated is a top view of the intermodal container 100, according to one or more embodiments. Like numerals from FIGS. 1A-1C that are used in FIG. 2 indicate like elements or components of the intermodal container 100 that are not necessarily described again in detail. The intermodal container 100 may be able to transition between a stowed configuration and a deployed configuration. As noted above, the intermodal container 100 is depicted in FIGS. 1A-1C in a deployed configuration and, therefore, ready for temporary or long-term use at a drilling site. In contrast, the intermodal container 100 as depicted in FIG. 2 is shown in a stowed configuration suitable for transport or shipping on a standard flatbed trailer, railcar, or as bulk cargo on an ocean vessel using standard container moving equipment and otherwise in accordance with the ISO global containerized intermodal freight transport system.

Notably, some or all of the component parts included in the intermodal container 100 (or otherwise coupled thereto) may be stowed and otherwise secured within the confines and/or geometric dimensions of the intermodal container 100 such that the intermodal container 100 is able to be shipped and transported in compliance with ISO regulations. More particularly, as illustrated, component parts of the intermodal container 100, such as the ladder 118, a walking platform 202 associated with the ladder 118, the sump conduit 122, the inlet conduit 124 (not shown), and the cross-connection conduit 126, may each be stowed on the roof 108 of the intermodal container 100 and secured thereto for transport. Each of these components may be secured to the roof 108 and otherwise arranged within the length 110, width 112, and height 114 (FIGS. 1A-1C) of the intermodal container 100, thereby allowing the intermodal container 100 to be stacked during transport without compromising the integrity of such components or the intermodal container 100 itself.

Figure 3A:
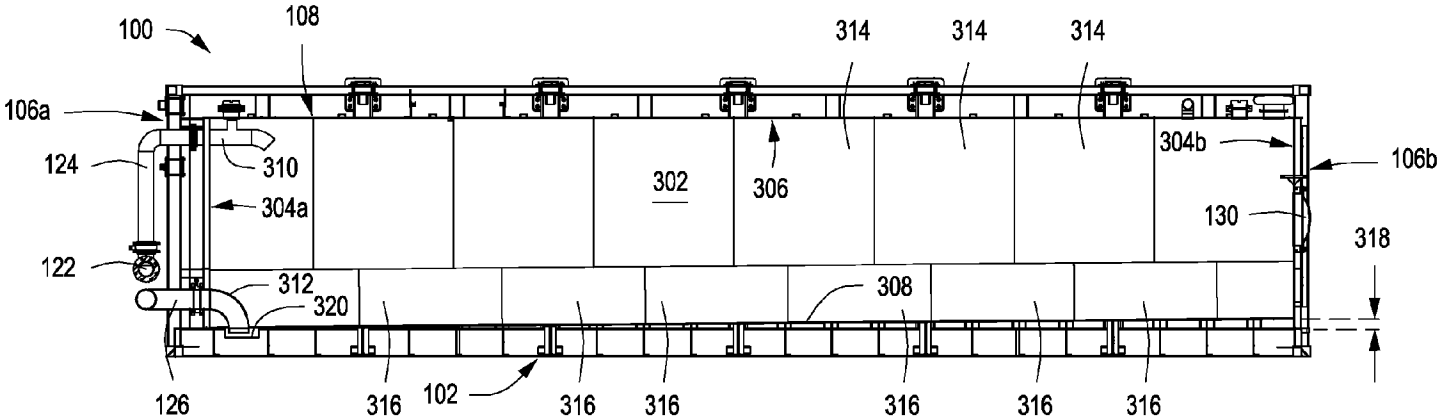
FIGS. 3A and 3B illustrate cross-sectional side and top views, respectively, of the intermodal container of FIGS. 1A-1C, according to one or more embodiments.
Figure 3B:
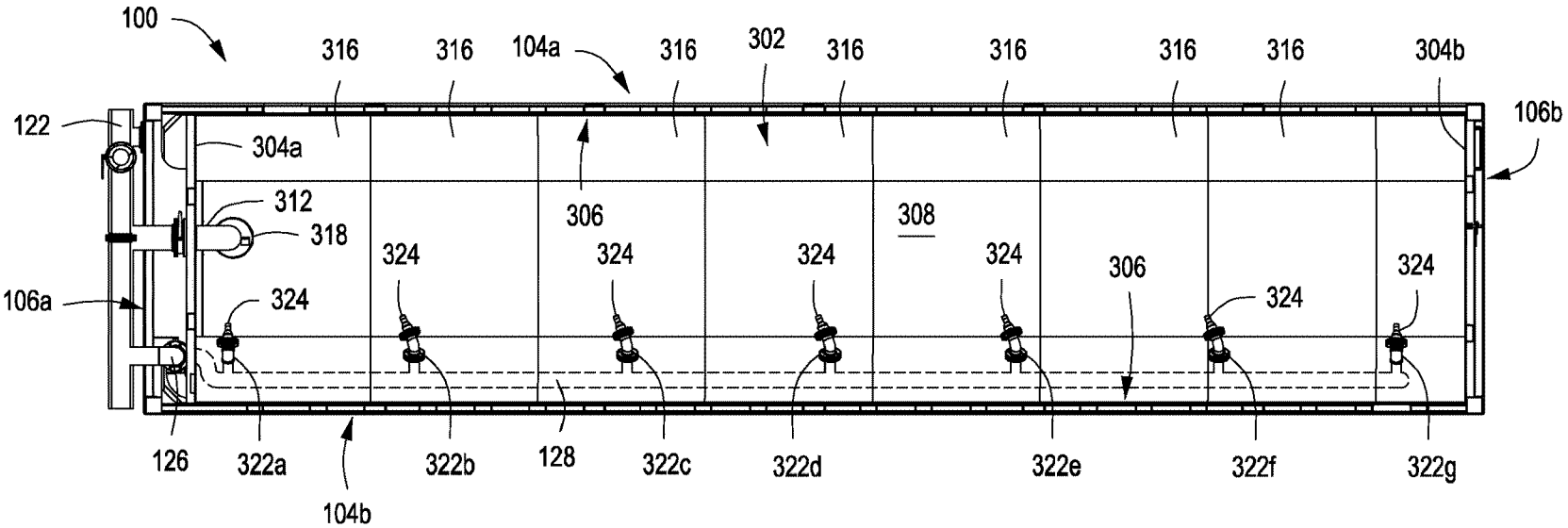

Referring now to FIGS. 3A and 3B, with continued reference to FIGS. 1A-1C, illustrated are cross-sectional side and top views, respectively, of the intermodal container 100, according to one or more embodiments. Again, like numerals from FIGS. 1A-1C that are used in FIG. 3 indicate like elements or components of the intermodal container 100 that are not necessarily described again. The intermodal container 100 of FIGS. 3A and 3B is depicted in the deployed configuration and otherwise ready for use at a drilling site.

With reference to the cross-sectional side view of FIG. 3A, a fluid tank 302 may be disposed within the intermodal container 100 and may include or otherwise define a suction end 304*a*, a back end 304*b*, a ceiling 306, and a floor 308. The suction end 304*a* may be adjacent the first end 106*a* of the intermodal container 100 and may facilitate fluid communication therethrough in order to circulate a fluid (e.g., drilling fluid) within the fluid tank 302. More particularly, a feed line 310 may extend through the first end 106*a* at the suction end 304*a* and into the fluid tank 302 at or near the ceiling 306, and may be fluidly coupled to the inlet conduit 124. Moreover, a sump 312 may extend through the first end 106*a* at the suction end 304*a* adjacent the floor 308 and may be fluidly coupled to the cross-connection conduit 126. The sump 312 may be configured to draw fluid from within the fluid tank 302 into the adjacent piping and/or conduits, and the feed line 310 may be configured to introduce or re-introduce the fluid into the fluid tank 302. As a result, the sump 312 and the feed line 310 may cooperatively operate to continuously circulate the fluid through the fluid tank 302.

In some embodiments, the floor 308 of the fluid tank 302 may be arcuate or otherwise rounded. More particularly, the walls 314 of the fluid tank 302 may be substantially vertical, but the floor 308 may include or otherwise be defined by a plurality of curved or arcuate panels 316 secured together to define a rounded floor 308 for the fluid tank 302. The rounded floor 308 may prove advantageous in preventing settlement of the fluid within the fluid tank 302 and otherwise mitigate solids buildup in corners that would otherwise be included in a polygonal-shaped floor 308.

In some embodiments, the floor 308 may also be sloped from the back end 304*b* to the suction end 304*a*. More particularly, the floor 308 may be arranged such that it is angled from the base 102 at an angle 318. The angle 318 may range from about 1° to about 20°, and may include any angular subset therebetween. As will be appreciated, the sloping disposition of the floor 308 may also prove advantageous in preventing settlement of the fluid within the fluid tank 302 as gravity will naturally urge the fluid to flow down the angled surface and toward the suction end 304*a* of the fluid tank 302. In some embodiments, the piping for the sump 312 may extend into a recess defined in the floor 308 and otherwise into a fluid collection reservoir 320 defined in the floor 308 at or near the suction end 304*a*. The sump 312 may be in fluid communication with the fluid collection reservoir 320 and otherwise configured to draw the fluid from the fluid tank 302 out of the fluid collection reservoir 320 for use or recirculation. The rounded and/or sloped floor 308 may help facilitate fluid flow toward the sump 312, and toward the fluid collection reservoir 320 that feeds the sump 312.

With reference to the cross-sectional top view of FIG. 3B, a plurality of mud guns 322 (seven shown as mud guns 322*a*, 322*b*, 322*c*, 322*d*, 322*e*, 322*f*, and 322*g*) may be arranged within the fluid tank 302 and otherwise extended at least partially through the arcuate panels 316 of the floor 308. While seven mud guns 322*a-g* are depicted in FIG. 3B, it will be appreciated that more or less than seven mud guns 322*a-g* may be employed in the intermodal container 100, without departing from the scope of the disclosure.

Each mud gun 322*a-g* may be fluidly coupled to the mud gun line 128 that runs longitudinally along the base 102 (FIG. 1A) of the intermodal container 100 exterior to the fluid tank 302. The mud gun line 128 may be fluidly coupled to the cross-connection conduit 126 and extend generally from the first end 106*a* toward the second end 106*b* to feed the fluid to each mud gun 322*a-g*. Notably, the mud gun line 128 may be arranged beneath and outside of the fluid tank 302, but nonetheless within the confines and/or geometric dimensions of the intermodal container 100 (e.g., within the length 110 and width 112 of FIGS. 1A-1C) such that the intermodal container 100 may be shipped and transported in compliance with the universal ISO standards.

Each mud gun 322*a-g* may include a nozzle 324 associated therewith, and each nozzle 324 may be configured to eject fluid (e.g., drilling fluid) into the fluid tank 302. As illustrated, the direction or angular orientation of one or more of the nozzles 324 may be manipulated to direct the fluid into the fluid tank 302 at varying angles with respect to the suction and back ends 304*a,b*. For instance, the nozzle 324 of the first mud gun 322*a* may be directed substantially parallel to the suction end 304*a* of the fluid tank 302. On the other hand, the nozzles 324 of the second, third, fourth, fifth, and sixth mud guns 322*b-f* may be angled toward the suction end 304*a* of the fluid tank 302 and otherwise configured to eject fluid toward the suction end 304*a*. In at least one embodiment, for example, the second, third, fourth, fifth, and sixth mud guns 322*b-f* may be angled toward the suction end 304*a* of the fluid tank 302 at an angle ranging between about 5° and about 30°. In some embodiments, as illustrated, the seventh mud gun 322*g* may be directed substantially parallel to the back end 304*b* of the fluid tank 302. In other embodiments, however, the seventh mud gun 322*g* may alternatively be angled toward or away from the back end 304*b*, without departing from the scope of the disclosure. In at least one embodiment, the angular orientation of the nozzles 324 for one or more of the mud guns 322*a-g* may be automated and otherwise actuatable during operation. Such automation may include, for example, the ability to selectively choke or stop fluid flow through one or more of the mud guns 322*a-g* in order to optimize circulation of the fluid within the fluid tank 302.

As will be appreciated, the combination of the rounded and/or sloped floor 308 and selective operation of the mud guns 322*a-g* may prove advantageous in preventing or mitigating the buildup of fluid settlement within the fluid tank 302. More particularly, the orientation of the mud guns 322*a-g* may encourage movement of larger particles suspended within the fluid towards the suction end 304*a* of the fluid tank 302 for recirculation through mud gun line 128 and back through the mud guns 322*a-g*. This reduces the amount of settlement and maintains a superior mix of the fluid, which may prove especially advantageous in storing and mixing drilling fluid used in drilling operations.

Figure 4:
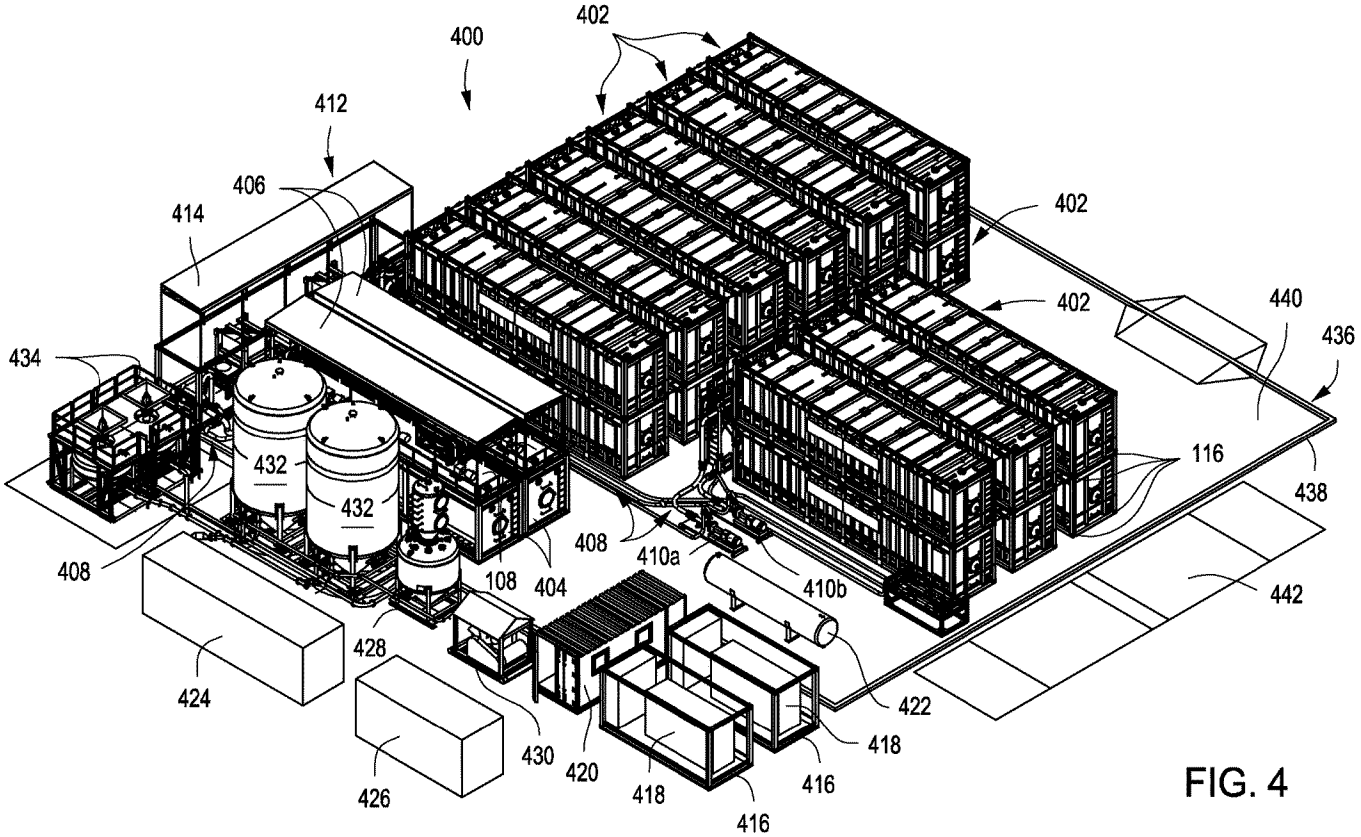
FIG. 4 illustrates an isometric view of an exemplary mobile drilling fluid plant, according to one or more embodiments.

Referring now to FIG. 4, with continued reference to the prior figures, illustrated is an isometric view of an exemplary mobile drilling fluid plant 400, according to one or more embodiments. As illustrated, the mobile drilling fluid plant 400 (hereafter "the plant 400") may include at least one or more fluid storage containers 402 and one or more fluid mixing containers 404. More particularly, FIG. 4 depicts eighteen fluid storage containers 402 and two fluid mixing containers 404. It will be appreciated, however, that more or less than eighteen fluid storage containers 402 and two fluid mixing containers 404 may be employed in the plant 400, without departing from the scope of the disclosure. In some embodiments, the fluid stored and/or mixed in the fluid storage and mixing tanks 402, 404 may be drilling fluid, including oil base drilling fluid, water base drilling fluid, and synthetic base drilling fluid, used in conjunction with drilling operations in the oil and gas industry. In other embodiments, however, the fluid may be any other type of fluid known to those skilled in the art including, but not limited to, fracking fluids, wellbore treatment fluids, completion fluids, kill fluids, and any combination thereof.

Each fluid storage and mixing tank 402, 404 may be similar in some respects to the intermodal container 100 of FIGS. 1A-1C, 2A-2B, and 3 and therefore may be best understood with reference thereto, where like numerals represent like elements not described again. Accordingly, each storage and mixing tank 402, 404 may be designed and otherwise configured as an intermodal shipping container compliant with ISO universal shipping dimensions and configurations and, therefore, able to be transported via the global containerized intermodal freight transport system. As a result, each fluid storage and mixing tank 402, 404 may be transported to the specific location for the plant 400 via ship, rail, and/or truck without requiring unloading and reloading of the contents disposed therein.

Moreover, each fluid storage and mixing tank 402, 404 may further include the castings 116 at each corner that may be used to stack multiple fluid storage and/or mixing tanks 402, 404 atop one another. In the illustrated embodiment, for example, the fluid storage containers 402 are stacked two-high and may be secured together at the corresponding castings 116 of each fluid storage container 402. In some embodiments, the fluid storage containers 402 may be stacked higher than two-high, but may equally be arranged independent from one another, without departing from the scope of the disclosure. As will be appreciated, stacking the fluid storage containers 402 atop one another may result in a smaller footprint for the plant 400, as compared to conventional, permanent drilling fluid plants.

In some embodiments, as illustrated, the fluid mixing containers 404 may each include a telescoping rooftop 406 that may be extended and otherwise deployed to allow various components associated with the fluid mixing containers 404 to be arranged on the roof 108 (i.e., a mixing deck) and otherwise protected from the elements (e.g., rain, sun exposure, etc.). The fluid storage and mixing tanks 402, 404 may be fluidly coupled to one another using a plurality of flexible hoses 408. The flexible hoses 408 may be any type of non-rigid hose, pipe, or conduit commonly used in the oil and gas industry and otherwise able to withstand pressures ranging between about 20 psig and about 150 psig. Suitable materials for the flexible hoses 408 include, but are not limited to, rubbers, elastomers, polymers, and plastics. In at least one embodiment, the flexible hoses 408 may be made of nitrile rubber, also known as acrylonitrile butadiene rubber, or neoprene.

In contrast to permanent drilling fluid plants, which commonly employ permanent and/or solid piping to interconnect fluid storage and mixing tanks, the flexible hoses 408 of the plant 400 may prove advantageous in allowing greater mobility and flexibility of the plant 400. Whereas permanent and solid piping requires the deployment of survey crews, time-consuming connections (i.e., bolting, welding, etc.), and setup lead times, the flexible hoses 408 of the plant 400 are relatively easy to install in the field and allow for a wide range of variation in their placement relative to other components of the plant 400. The flexible hoses 408 may be considered as a semi-permanent part of the plant 400 since they are only manipulated at the commissioning and decommissioning phases for the plant 400.

The flexible hoses 408 may be fluidly coupled to one or more pumps 410 (shown as a first pump 410*a* and a second pump 410*b*) configured to help transfer the fluid between adjacent fluid storage containers 402 and also between the fluid storage containers 402 and the fluid mixing containers 404. The pumps 410*a,b* may be, for example, centrifugal pumps, but may equally be any other type of pump, such as positive displacement pumps. Each pump 410*a,b* may be standardized for the plant 400 in its sizing and/or configuration (including any integral and/or added components thereof) such that, if needed, the pumps 410*a,b* may be easily replaced and/or serviced, even in a remote location where the plant 400 may be established. As illustrated, each pump 410*a,b* may be secured to a corresponding skid (not labeled) which allows the pumps 410*a,b* to be transported to the drill site and installed with ease.

The plant 400 may further include one or more mix hopper containers 412 (one shown) configured to house various components that support the fluid mixing containers 404. For instance, the mix hopper container 412 may include one or more venturi mixing hoppers, one or more big bag hoppers, and one or more transfer pumps, all enclosed within the confines of the mix hopper container 412. Similar to the fluid storage and mixing tanks 402, 404, the mix hopper container 412 may be similar to the intermodal container 100 described herein and therefore may be designed and otherwise configured as an intermodal shipping container compliant with ISO universal dimensions and configurations. As a result, the mix hopper container 412 may be able to be transported via the global containerized intermodal freight transport system to the specific location for the plant 400 without requiring unloading and reloading of the contents disposed therein.

In some embodiments, as illustrated, the mix hopper container 412 may include a telescoping rooftop 414, similar to the telescoping rooftop 406 of the fluid mixing containers 404. The telescoping rooftop 414 may be extended and otherwise deployed to protect the contents of the mix hopper container 412 from the elements (e.g., rain, sun exposure, etc.). The components included within the mix hopper container 412 may be in fluid communication with the fluid mixing containers 404 via one or more flexible hoses 408.

The plant 400 may further include one or more generator containers 416 (two shown) configured to house corresponding generators 418. In FIG. 4, the walls and ceiling of the generator containers 416 are omitted to expose the generators 418, but would otherwise include both walls and a ceiling. In some embodiments, the plant 400 may also include a motor control center container 420 situated adjacent the generator containers 416 and otherwise used to monitor, regulate, and operate the generators 418. The generator containers 416 and the motor control center container 420 may also be designed and otherwise configured as intermodal shipping containers compliant with ISO universal dimensions and configurations, and thereby capable of being transported via the global containerized intermodal freight transport system to the specific location for the plant 400. In the illustrated embodiment, the generator containers 416 and the motor control center container 420 each exhibit a length that is shorter than the length of the fluid storage and mixing tanks 402, 404. More particularly, the fluid storage and mixing tanks 402, 404 may exhibit a length 110 (FIG. 1A) of 40 feet, whereas the generator containers 416 and the motor control center container 420 may exhibit a length 110 (FIG. 1A) of 20 feet, but nonetheless in compliance with ISO shipping standards.

The generators 418 may be any type of power generating device configured to power the plant 400, especially in areas that may not include a power grid and/or before electrical power can be extended to the particular site or area. In some embodiments, the generators 418 may be "gensets" powered by diesel fuel, natural gas, or any other source of fuel. As illustrated, the plant 400 may also include a fuel tank 422 configured to supply fuel for the generators 418 to generate electricity. In some embodiments, the plant 400 may include only a single generator 418. Having two generators 418, however, may provide redundancy in the power generating capability of the plant 400. As will be appreciated, this may prove advantageous in allowing the plant 400 to continuously operate in the event a primary generator fails, is being repaired, or is otherwise inoperable. While the primary generator is offline, the secondary generator may be activated to provide the required power for the plant 400, and thereby minimize potential downtime.

Accordingly, the generator containers 416 and the associated generators 418 may allow the plant 400 to be deployed outside the power grid and/or before power can be extended to the site. In some embodiments, however, the generators 418 may be disconnected when the plant 400 is otherwise able to tap into a local power grid.

In some embodiments, the plant 400 may further include other components or containers useful in helping to provide drilling fluid to an adjacent drilling rig or site. For instance, in at least one embodiment, the plant 400 may include one or more office containers 424 (one shown) and one or more fluid testing containers 426 (one shown). The office container 424 may include, for example, a rest room and/or work area for well operators stationed at the plant 400. The office container 424 may be connected via satellite in order to provide a well operator with Internet access and communication with global lab networks. The fluid testing container 426 may comprise a self-contained testing and evaluation lab facility that may be used by well operators to test fluids, such as drilling fluids.

Similar to the fluid storage and mixing tanks 402, 404, the office and fluid testing containers 424, 426 may be similar to the intermodal container 100 described herein and therefore may be designed and otherwise configured as intermodal shipping containers compliant with ISO universal dimensions and configurations. As a result, the office and fluid testing containers 424, 426 may be able to be transported via the global containerized intermodal freight transport system to the specific location for the plant 400 without requiring unloading and reloading of the contents disposed therein. As illustrated, in some embodiments, the office container 424 may comprise a 40-foot long intermodal container. In other embodiments, however, the office container 424 may comprise two 20-foot containers coupled to one another. In at least one embodiment, one of the 20-foot containers may include the office and rest room facilities, and the other 20-foot container may enclose and otherwise house, for example, a genset, such as one of the generators 418. Moreover, as illustrated, in some embodiments, the fluid testing container 426 may comprise a 20-foot long intermodal container. In other embodiments, however, the fluid testing container 426 may comprise a 40-foot long intermodal container, or two 20-foot containers coupled to one another, without departing from the scope of the disclosure.

Other components that may be included in the plant 400 include, but are not limited to, a dust collector 428, an air compressor 430, one or more dry additive silos 432 (two shown), and one or more cutting pods 434 (two shown). While not specifically shown in FIG. 4, in some embodiments, the plant 400 may further include an overflow unit or system configured to catch overflow spills that may occur from the fluid storage containers 402. Piping may fluidly couple the overflow system and the storage tanks 402 such that any fluid overflow is contained within an overflow tank associated with the overflow system. As can be appreciated, such an overflow system may prove useful in keeping spills off the ground.

Exemplary setup of the plant 400 is now provided. Prior to delivering the components of the plant 400, the site for the plant 400 must first be prepared. Such preparation includes preparing a containment area 436 that extends around the periphery of the plant 400 and is configured to contain potential fluid spills during operation of the plant 400. Preparing the containment area 436 may first include grading the land such that a flattened earthen area results. A wall 438 may then be built that extends around the periphery of the plant 400. The wall 438 may comprise several steel posts (not shown) driven into the ground and placing steel walls or slats (not shown) between each offset steel post. In other embodiments, however, the wall 438 may alternatively be formed out of an earthen berm formed about the periphery of the plant 400. A liner 440, such as a fabric retention barrier, may then be lapped up and over the wall 438. A layer of sand or gravel (not shown) may then be placed on top of the liner 440.

At this point, the various components and/or containers of the plant 400 may be delivered to the site for locating them within the footprint of the plant 400. In some embodiments, the plant 400 may have a loading/unloading zone 442 where trucks or other vehicles (e.g., boats in the event the plant 400 is built adjacent a body of water) may deliver the components and/or containers of the plant 400. A portable onsite crane or forklift (not shown) may be used to offload the components and/or containers into the containment area. The fluid storage and mixing tanks 402, 404, the mix hopper container 412, and the fuel tank 422 may each be placed on the sand/gravel base and otherwise on top of the liner 440. Notably, the plant 400 does not require that concrete footings or other permanent structures be added in order to place the storage and mixing tanks 402, 404, the mix hopper container 412, and the fuel tank 422. The other components of the plant 400, such as the generator containers 416, the motor control center container 420, the office 424, the fluid testing container 426, the dust collector 428, the air compressor 430, the dry additive silos 432 (two shown), and the cutting pods 434 may be placed without the containment area.

Once the fluid storage and mixing tanks 402, 404 are deployed, the hoses 408 may be run therebetween and to the pumps 410*a,b* to fluidly couple the components. Fluid may circulate between adjacent fluid storage containers 402, or any other fluid storage container 402, using appropriate valving, as discussed briefly above. Such valving may further accommodate fluid transfer between the fluid mixing containers 404 and the fluid storage containers 402. The loading/unloading zone 442 may also be used to deliver and offload fluid (e.g., drilling fluid) to the plant 400, and the valving may further facilitate fluid transfer between the loading/unloading zone 442 to any one of the fluid storage containers 402. As will be appreciated, such valving may prove advantageous in reducing the potential for spills and otherwise operating the plant 400 similar to a permanent facility.

In some cases, the plant 400 may be mobilized and made operational within one to two weeks upon arrival and can be configured to operator specifications and size requirements without the long lead times associated with conventional mud plant installations. Moreover, the plant 400 may be able to be demobilized (e.g., disassembled) in about the same amount of time using the same equipment. In addition, because of the mobile nature of the plant 400, the plant 400 may be able to be commissioned before it is shipped since the components of the plant 400 may be assembled practically anywhere. Following the commissioning phase, the plant 400 may be disassembled, shipped, and subsequently reassembled on location where it can be commissioned once again.

Embodiments disclosed herein include:

A. An intermodal container that includes a structure including a base, opposing first and second sidewalls, opposing first and second ends, and a roof, wherein the structure exhibits a length, a width, and a height compliant with universal shipping container dimensions and configurations dictated by the International Organization for Standardization, a fluid tank disposed within the structure and providing a suction end, a back end, a ceiling, and a floor, the suction end being adjacent the first end and the back end being adjacent the second end, a sump arranged within the fluid tank at the suction end and extending through the first end to draw fluid out of the fluid tank, and a plurality of mud guns extended at least partially through the floor of the fluid tank, each mud gun including a nozzle associated therewith and operable to eject fluid into the fluid tank.

B. A mobile drilling fluid plant that includes a plurality of intermodal containers each exhibiting a length, a width, and a height compliant with universal shipping container dimensions and configurations dictated by the International Organization for Standardization, wherein the plurality of intermodal containers include a plurality of fluid storage containers and one or more fluid mixing containers, one or more pumps in fluid communication with the plurality of fluid storage containers and the one or more fluid mixing containers, and one or more flexible hoses fluidly coupled to the one or more pumps and placing the plurality of fluid storage containers in fluid communication with the one or more fluid mixing containers.

C. A method of assembling a mobile drilling fluid plant that includes preparing a containment area for the mobile drilling fluid plant, delivering a plurality of intermodal containers to the mobile drilling fluid plant, wherein each intermodal container exhibits a length, a width, and a height compliant with universal shipping container dimensions and configurations dictated by the International Organization for Standardization, and wherein the plurality of intermodal containers include a plurality of fluid storage containers and one or more fluid mixing containers, offloading the plurality of intermodal containers and placing at least the plurality of fluid storage containers and the one or more fluid mixing containers within the containment area, and fluidly coupling the plurality of fluid storage containers and the one or more fluid mixing containers using one or more flexible hoses in fluid communication with one or more pumps.

Each of embodiments A, B, and C may have one or more of the following additional elements in any combination: Element 1: wherein the fluid is drilling fluid and the structure is at least one of a drilling fluid storage container and a drilling fluid mixing container. Element 2: wherein the structure is movable between a stowed configuration and deployed configuration, and, when in the stowed configuration, component parts of the structure are secured to the structure within confines of the length, the width, and the height. Element 3: wherein at least some of the component parts are stowed on the roof in the stowed configuration and are selected from the group consisting of a ladder, a walking platform, a sump conduit, an inlet conduit, and a cross-connection conduit. Element 4: further comprising a mud gun line running longitudinally along the base from the first end toward the second end and exterior to the fluid tank, the mud gun line being fluidly coupled to each mud gun to provide the fluid thereto, wherein the mud gun line extends within confines of the length, the width, and the height of the structure. Element 5: wherein the floor of the fluid tank is at least one of sloped from the back end to the suction end and rounded. Element 6: wherein one or more of the nozzles are directed toward the suction end of the fluid tank. Element 7: wherein the plurality of mud guns includes a distal mud gun adjacent the back end of the fluid tank, and the nozzle of the distal mud gun is oriented at least one of parallel to the back end and angled toward the back end.

Element 8: wherein the plurality of fluid storage containers include at least two fluid storage containers stacked atop one another. Element 9: wherein at least one of the one or more fluid mixing containers includes a telescoping rooftop. Element 10: wherein each fluid storage container and each fluid mixing container comprises a fluid tank disposed therein and providing a suction end, a back end, a ceiling, and a floor, a sump arranged within the fluid tank at the suction end and extending through the suction end to draw fluid out of the fluid tank, and a plurality of mud guns extended at least partially through the floor of the fluid tank, each mud gun including a nozzle associated therewith and operable to eject fluid into the fluid tank. Element 11: wherein each fluid storage container and each fluid mixing container further comprises a mud gun line running longitudinally from the suction end toward the back end and exterior to the fluid tank, the mud gun line being fluidly coupled to each mud gun. Element 12: wherein the floor of one or more of the fluid tanks is at least one of sloped from the back end toward the suction end and rounded. Element 13: wherein one or more of the nozzles of one or more of the fluid tanks is directed toward the suction end of the one or more fluid tanks. Element 14: wherein the plurality of intermodal containers further includes one or more mix hopper containers in fluid communication with the one or more fluid mixing containers. Element 15: wherein the plurality of intermodal containers further includes one or more generator containers, each generator container housing at least one generator. Element 16: wherein the plurality of intermodal containers further includes a motor control center container communicably coupled to the at least one generator. Element 17: wherein the plurality of intermodal containers further includes at least one of an office container and a fluid testing container.

Element 18: wherein delivering the plurality of intermodal containers to the mobile drilling fluid plant comprises shipping the plurality of intermodal via a global containerized intermodal freight transport system that transports the plurality of intermodal containers using at least one of a ship, rail, and a truck. Element 19: wherein the plurality of fluid storage containers include at least two fluid storage containers and offloading the plurality of intermodal containers further comprises stacking the at least two fluid storage containers atop one another. Element 20: wherein the plurality of intermodal containers further includes one or more generator containers and offloading the plurality of intermodal containers further comprises offloading the one or more generator containers, each generator container housing at least one generator, and providing power to the mobile drilling fluid plant with the at least one generator. Element 21: wherein the plurality of intermodal containers further includes a motor control center container, the method further comprising operating the at least one generator with the motor control center container. Element 22: wherein the at least one generator includes a first generator and a second generator and providing power to the mobile drilling fluid plant comprises providing power to the mobile drilling fluid plant with the first generator, and providing power to the mobile drilling fluid plant with the second generator when the first generator is inoperable.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A mobile drilling fluid plant, comprising:

a plurality of intermodal containers each exhibiting a length, a width, and a height compliant with universal shipping container dimensions and configurations dictated by the International Organization for Standardization, wherein the plurality of intermodal containers include a plurality of fluid storage containers and one or more fluid mixing containers;

one or more pumps in fluid communication with the plurality of fluid storage containers and the one or more fluid mixing containers; and one or more flexible hoses fluidly coupled to the one or more pumps and placing the plurality of fluid storage containers in fluid communication with the one or more fluid mixing containers;

wherein each fluid storage container and each fluid mixing container comprises:

a fluid tank disposed therein and providing a floor; and a plurality of mud guns extending at least partially through the floor of the fluid tank.

2. The mobile drilling fluid plant of claim 1, wherein the plurality of fluid storage containers include at least two fluid storage containers stacked atop one another.

3. The mobile drilling fluid plant of claim 1, wherein at least one of the one or more fluid mixing containers includes a telescoping rooftop.

4. The mobile drilling fluid plant of claim 1, wherein each fluid storage container and each fluid mixing container further comprises:

a sump arranged within the fluid tank at a suction end and extending through the suction end to draw fluid out of the fluid tank; and each mud gun including a nozzle associated therewith and operable to eject fluid into the fluid tank.

5. The mobile drilling fluid plant of claim 4, wherein each fluid storage container and each fluid mixing container further comprises a mud gun line running longitudinally from the suction end toward a back end and exterior to the fluid tank, the mud gun line being fluidly coupled to each mud gun.

6. The mobile drilling fluid plant of claim 4, wherein the floor of one or more of the fluid tanks is at least one of sloped from a back end toward the suction end and rounded.

7. The mobile drilling fluid plant of claim 4, wherein one or more of the nozzles of one or more of the fluid tanks is directed toward the suction end of the one or more fluid tanks.

8. The mobile drilling fluid plant of claim 1, wherein the plurality of intermodal containers further includes one or more mix hopper containers in fluid communication with the one or more fluid mixing containers.

9. The mobile drilling fluid plant of claim 1, wherein the plurality of intermodal containers further includes one or more generator containers, each generator container housing at least one generator.

10. The mobile drilling fluid plant of claim 9, wherein the plurality of intermodal containers further includes a motor control center container communicably coupled to the at least one generator.

11. The mobile drilling fluid plant of claim 1, wherein the plurality of intermodal containers further includes at least one of an office container and a fluid testing container.

12. The mobile drilling fluid plant of claim 1, wherein each of the mud guns includes a nozzle associated therewith and operable to eject fluid into the fluid tank.

13. The mobile drilling fluid plant of claim 12, wherein the nozzles are directed in different directions with respect to an end of the fluid tank.

14. The mobile drilling fluid plant of claim 12, wherein the nozzles comprise:

a first nozzle substantially parallel to an end of the fluid tank; and a second nozzle.

15. The mobile drilling fluid plant of claim 14, wherein the second nozzle is at an angle of between about 5° and about 30° with respect to the end of the fluid tank.

* * * * *